United States Patent [19]

Dumortier

[11] 4,192,233

[45] Mar. 11, 1980

[54] SHELL FOR SPORTING CARTRIDGE OF PLASTIC MATERIAL

[75] Inventor: Thierry M. Dumortier, Liége, Belgium

[73] Assignee: Fabriqe Nationale Herstal, en abrege FN, Herstal, Belgium

[21] Appl. No.: 886,474

[22] Filed: Mar. 14, 1978

[30] Foreign Application Priority Data

Sep. 27, 1977 [BE] Belgium ..... 56275

[51] Int. Cl.[2] ..... F42B 9/30

[52] U.S. Cl. ..... 102/43 P

[58] Field of Search ..... 102/43 R, 43 P

[56] References Cited

U.S. PATENT DOCUMENTS

| | | | |
|---|---|---|---|
| 2,654,319 | 10/1953 | Roske | 102/43 P |
| 3,093,073 | 6/1963 | Lockwood et al. | 102/43 P |
| 3,424,089 | 1/1969 | Humpherson | 102/43 P |
| 3,977,326 | 2/1975 | Anderson et al. | 102/43 P |
| 4,140,058 | 2/1979 | Ballreich et al. | 102/43 P |

*Primary Examiner*—Verlin R. Pendegrass

*Attorney, Agent, or Firm*—Bacon & Thomas

[57] ABSTRACT

Shell for sporting cartridge of plastic material, fabricated in two parts, namely an extruded cylindrical case and a moulded cap containing base, assembled by welding, characterized by the fact that aforesaid case is provided with a conical part at one end, whereas the base is provided with a corresponding conical seat for the purpose of receiving aforesaid conical extremity of the case, the conical surfaces in contact with each other being made integral by an area of continuous welding.

4 Claims, 3 Drawing Figures

SHELL FOR SPORTING CARTRIDGE OF PLASTIC MATERIAL

The present invention pertains to a shell for a sporting cartridge of plastic material, fabricated in two parts which are assembled to each other by welding.

The idea of fabricating shells in two parts, both of plastic material, is not new (see for instance Belgian Pat. Nos. 434.718 of 1939 and No. 448.669 of 1942). Since then, various manners of fabrication of such shells have been suggested.

Generally, these constructions differ from each other by the means used for assembling the base to the shell case. Most often, the proposed joints require the engagement or interpenetration of extra elements provided on the base and on the case (Belgian Pat. Nos. 746.397 No. 778.935, British Pat. No. 988.596). Such solutions are generally costly, not merely due to the fact that they require relatively complex moulds, but chiefly because they do not permit an extremely rapid assembly, which is essential for the economy of mass production.

More recently, shells were suggested consisting of a base and a case, the latter being cylindrical and having one of its ends fitting over a corresponding cylindrical part of the base, part which is provided with a sealing lip. In such known shells, the assembly of the cylindrical parts in contact with each other is carried out by ultrasonic welding.

The shells of this type are of economic interest as compared with the traditional shells. They do however offer the inconveniences inherent to their shaping and to their fabrication process. We have for instance that the bead, which is made integral with the base, must protrude from the body of the latter by a sufficient distance to accomodate the thickness of the case. This may cause problems of resistance to the action of extractors in sporting guns. On the other hand, it is not possible to weld above-mentioned lip to the case without risk of weakening the latter. In fact, such an ultrasonic weld would require an energy controller on the lip and consequently a weakening of the case at the level of the latter after welding.

The purpose of the present invention is to avoid the above-mentioned inconveniences.

This purpose is reached, according to the invention, by a shell of the type under consideration, in which the cylindrical case is provided with a cone at one end, whereas the base is provided with a conical seat for the purpose of accomodating aforesaid conical extremity of the case.

These characteristics assure, amongst others, the maximum solidity of the bead as well as the ease of carrying out the weld between case and base by rotation, by friction, by ultrasound, etc. A continuous weld can moreover easily be obtained, and consequently also a perfectly sealed cartridge.

For clearness' sake, two forms of embodiment according to the invention are described hereinafter, merely as examples and without intent of limitation, with reference to the appended drawings, in which.

Figure 1:
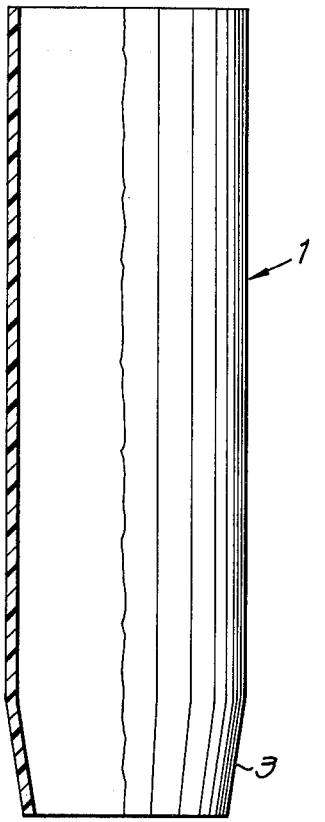
FIG. 1 is an exploded view, with half axial section, of a shell according to the invention.

The illustrated shell is made up of two elements of thermo-weldable plastic material: an extruded cylindrical case 1 and an injection moulded base 2.

The case is conically shaped at its extremity 3, whereas the base 2 is provided with a corresponding conical seat 4.

This conical seat 4 is extended by a cylindrical skirt 5, the inner diameter of which is approximately the same as the outer diameter of case 1, in its cylindrical part.

The base 2 comprises a bead 6, as well as a housing 7 for the cap.

Figure 2:
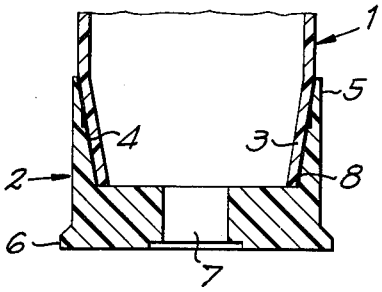
FIG. 2 shows, to a larger scale, the junction between the two constituent parts of the shell illustrated in FIG. 1.

In order to assemble case 1 and base 2, it will be sufficient to bring these elements in the position illustrated in FIG. 2 and to cause them to rotate with respect to each other, either in continuous or in reciprocating movement, but with sufficient velocity to assure the welding of the surfaces in contact. This weld 8 is continuous and independent of fabrication tolerances.

These arrangements permit the use of extremely simple moulds and a very high fabrication speed by means of tooling which is also very simple for carrying out the assembly of the bases and cases. Moreover, any tolerances in the length of the case, the angle of the conical part, etc. are most easily absorbed.

Skirt 5 prevents molten matter from reaching the cylindrical surface of case 1 and forming burrs there.

Figure 3:
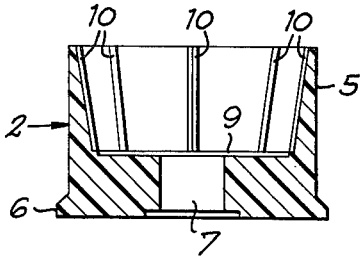
FIG. 3 shows an alternative form of embodiment of the base, for assembly by means of ultrasonic welding.
Figure 3:
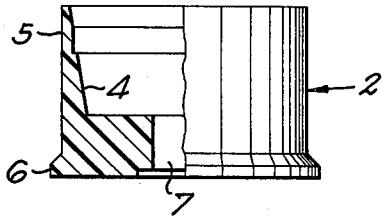

In the form of embodiment according to FIG. 3, base 2 is intended to be made integral with case 1 shown in FIG. 1 by ultrasonic welding.

For this purpose, conical seat 4 is provided with a plurality of ribs which form energy controllers. One of these ribs is annular and is located close to the bottom of the base, as shown in 9. The other ribs 10 are directed along generatrices of seat 4. We thus obtain an assembly of base and case which is sufficiently strong, and moreover perfectly sealed.

Case 1 and base 2 may be made of one and the same material, or of different materials, providing that in the latter case, their melting temperatures are similar.

It is obvious that alterations of details can be applied to the above-described example, without going beyond the scope of the invention.

What I claim is:

1. In a shell for a sporting cartridge of plastic material comprising two parts, an extruded cylindrical case and a molded cap containing base, assembled by welding, said case being provided with a conical end, the base being provided with a corresponding conical seat for the purpose of recieving said conical end of the case, the conical surfaces being in contact with each other and made integral by an area of continuous welding, said welding being performed by rotating said case and said base with respect to each other, with sufficient velocity to ensure the welding of the surfaces in contact.

2. Shell according to claim 1, characterized by the fact that aforesaid conical seat is extended by a cylindrical skirt, the internal diameter of which is practically equal to the external diameter of the case.

3. Shell according to claim 1, characterized by the fact that both the case and the base are made of one and the same plastic material.

4. Shell according to claim 1, characterized by the fact that the case and the base are made of different plastic materials, which do however have neighbouring melting temperatures.

* * * * *